US011939122B2

(12) United States Patent
De Cat

(10) Patent No.: US 11,939,122 B2
(45) Date of Patent: Mar. 26, 2024

(54) CHILD-SAFE PACKAGING

(71) Applicant: DECA PACKAGING GROUP verkort DECA, naamloze vennootschap, Herentals (BE)

(72) Inventor: Patrik De Cat, Herentals (BE)

(73) Assignee: DECA PACKAGING GROUP verkort DECA, naamloze vennootschap, Herentals (BE)

( * ) Notice: Subject to any disclaimer, the term of this patent is extended or adjusted under 35 U.S.C. 154(b) by 209 days.

(21) Appl. No.: 17/762,611

(22) PCT Filed: Sep. 22, 2020

(86) PCT No.: PCT/IB2020/058822
§ 371 (c)(1),
(2) Date: Mar. 22, 2022

(87) PCT Pub. No.: WO2021/059121
PCT Pub. Date: Apr. 1, 2021

(65) Prior Publication Data

US 2022/0348388 A1 Nov. 3, 2022

(30) Foreign Application Priority Data

Sep. 23, 2019 (BE) ..... 2019/5623

(51) Int. Cl.
*B65D 50/04* (2006.01)
*B65D 43/16* (2006.01)

(52) U.S. Cl.
CPC ..... *B65D 50/045* (2013.01); *B65D 43/162* (2013.01)

(58) Field of Classification Search
CPC ..... B65D 50/00; B65D 50/02; B65D 50/04; B65D 50/045; B65D 43/162
USPC ..... 206/1.5
See application file for complete search history.

(56) References Cited

U.S. PATENT DOCUMENTS 3,761,010 A * 9/1973 Rosenburg, Jr. ..... B65D 5/38 206/804
7,464,828 B1 * 12/2008 Unrau ..... A47K 17/00 220/8
7,780,000 B2 * 8/2010 Mazzucchelli ..... E05B 73/0023 220/8
8,833,115 B2 * 9/2014 Nakasuji ..... E05B 73/0023 340/572.8
2004/0211680 A1 * 10/2004 Hirschel ..... B65D 77/0453 206/320

(Continued)

FOREIGN PATENT DOCUMENTS

DE 2952617 A1 7/1981

OTHER PUBLICATIONS

International Search Report & Written Opinion to corresponding PCT Application No. PCT/IB2020/058822 dated Feb. 2, 2021.

*Primary Examiner* — Jacob K Ackun
(74) *Attorney, Agent, or Firm* — Dinsmore & Shohl LLP

(57) ABSTRACT

Packaging from synthetic material or biopolymers, consisting of a box with lid, whereby the lid is hingedly attached on one side to the box and on the other side is provided with a gripping edge, with which the lid can be lifted to open the lid, whereby the gripping edge is made inaccessible by a casing located around the box, said casing having to be manipulated to make the gripping edge accessible, after which the lid can be manually lifted.

7 Claims, 2 Drawing Sheets

(56) References Cited

U.S. PATENT DOCUMENTS

| | | | | |
|---|---|---|---|---|
| 2010/0300046 | A1 | 12/2010 | Repkin et al. | |
| 2016/0152373 | A1* | 6/2016 | Linssen ..... | B65D 5/38<br>206/1.5 |

* cited by examiner

CHILD-SAFE PACKAGING

CROSS-REFERENCE TO RELATED APPLICATIONS

The present application is the National Phase entry of International Patent Application No. PCT/IB2020/058822 filed Sep. 22, 2020, which claims priority to Belgium Patent Application No. 2019/5623 filed Sep. 23, 2019, the entire contents of both are hereby incorporated by reference into this application.

TECHNICAL FIELD

The present disclosure relates to a child-safe packaging for packaging consumer goods or other goods that can be harmful for children.

In particular, the present disclosure is intended for packaging smoking materials or medication or other consumables intended for adults but which may be harmful to children.

BACKGROUND

Generally known are the secure caps of bottles of chemicals or medicines, which cannot be unscrewed like normal caps, but must first be pushed in or squeezed together before the child-safe cap can be opened.

SUMMARY

In addition to bottles, synthetic packaging is also used, consisting of a box with a lid, which is opened by pulling open the lid of the box. To also make said packaging childsafe, the present disclosure aims at packaging made from synthetic material or biopolymers, consisting of a box with a lid, whereby the lid is hingedly attached to the box on one side and on the other side is provided with a gripping edge, with which the lid can be lifted to open the lid, whereby the gripping edge is made inaccessible by a casing located around the box, said casing having to be manipulated to free the gripping edge, after which the lid can be manually lifted.

An aspect of such packaging is that a child that comes into the possession of the packaging does not know said manipulation and therefore cannot open the lid.

In some embodiments, the box with lid and hinge is injection-moulded in one piece and the casing is injection-moulded as a separate component.

This is made possible because the hinge with which the lid is hingedly attached to the box on one side, is made from the same synthetic material or the same biopolymer as the box and the lid and is part of one single injection-moulded piece.

In addition, the casing is injection-moulded as a separate component and every box with lid is placed in a casing whereby the casing is fitted around the box and the top edge of the casing protrudes from the top edge of the lid or is flush with it, such that the gripping edge of the lid is not accessible to a hand that wants to open the box.

The casing around the box can be manipulated by compressing and/or pushing down said casing, whereby the gripping edge of the lid is made accessible to open the lid by hand.

In some embodiments, the lid is provided with an edge farming an air- and odour-tight seal with the box when the lid is closed.

An aspect of such a closing edge is that the packaging can be used to package odorous components such as smoking materials or medication.

In some embodiments, the box with lid is made from a recyclable synthetic material or a biodegradable material, such that environmental pollution by the packaging material is avoided.

BRIEF DESCRIPTION OF THE DRAWINGS

With the intention of better showing the characteristics of the present disclosure, an embodiment of a child-safe packaging according to the present disclosure is described hereinafter, by way of an example without any limiting nature, with reference to the accompanying drawings wherein.

DETAILED DESCRIPTION

Figure 1:
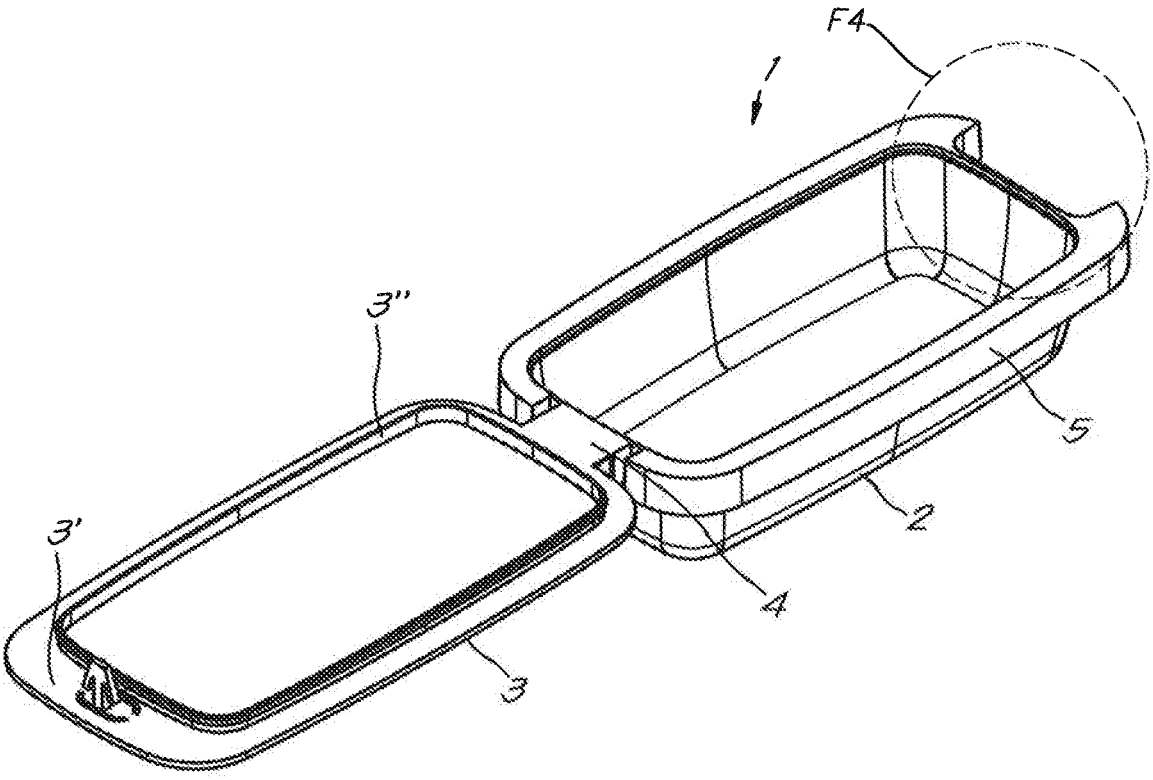
FIG. 1 schematically shows a perspective view of a box with opened lid according to the present disclosure.

FIG. 1 schematically shows a perspective view of a packaging 1 according to the present disclosure, consisting of a box 2 with a lid 3 connected to each other by a hinge 4 made from the same polymer. The box 2 is provided with a wide edge 5 and the lid 3 is provided with a gripping edge 3'.

Figure 2:
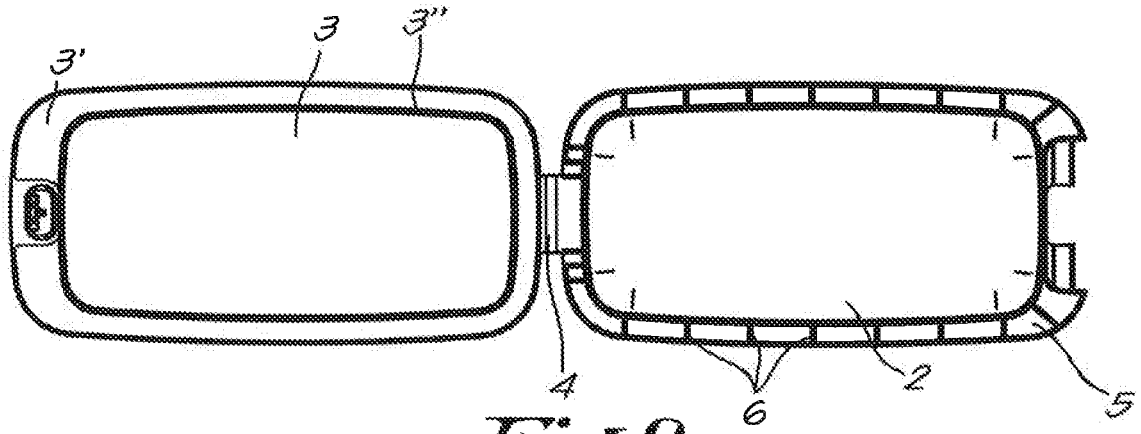
FIG. 2 shows a top view of FIG. 1.

FIG. 2 shows the top view of the box 2 with lid 3, on which it can be seen that the edge 5 is supported on by support ribs 6, which provide the edge 5 with the required rigidity. The lid is provided with an airtight edge 3" which seals the box in closed condition in an air- and odour-tight way.

Figure 3:
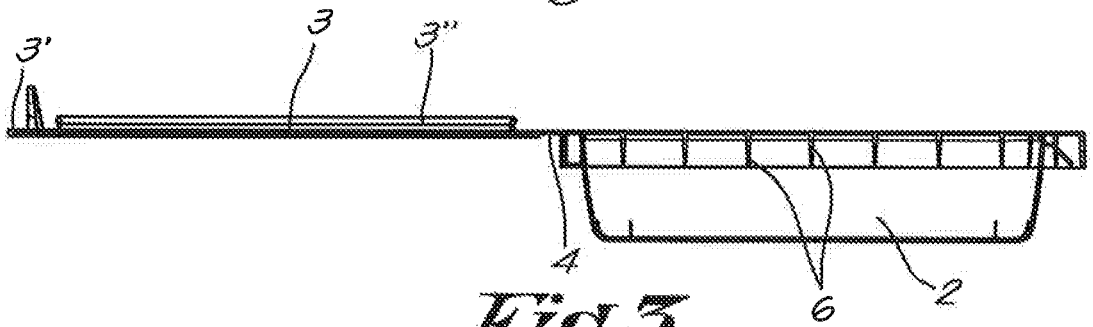
FIG. 3 shows a side view of FIG. 1.

FIG. 3 shows a side view of the box 2 with lid 3, on which it can be seen that the hinge 4 consists of a thin foldable piece of polymer which forms an integral part of the box 2 with lid 3 which is injection-moulded as one piece.

Figure 4:
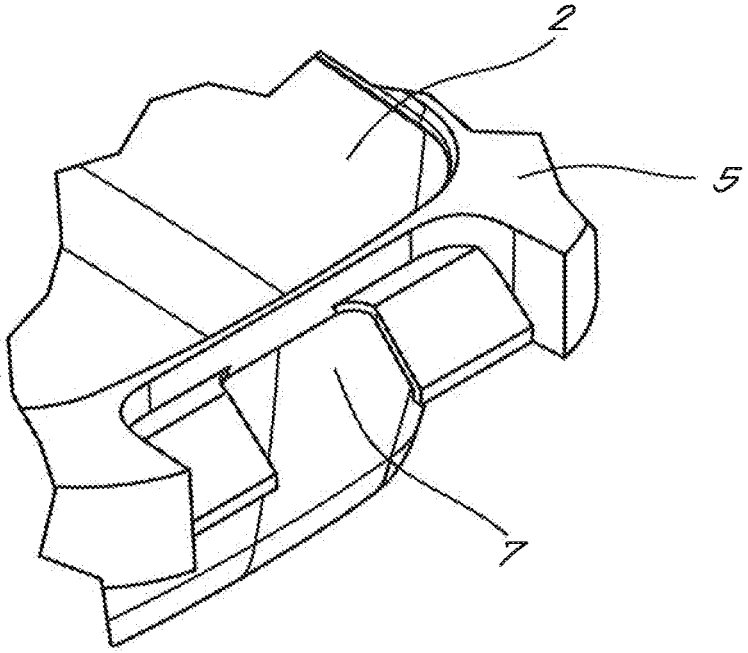
FIG. 4 shows a component of FIG. 1 indicated with F4 on a larger scale.

FIG. 4 shows the edge 5 of the box 2 in more detail in which a recess 7 is provided to be able to grip the gripping edge 3' of the lid 3 when the gripping edge 3' is accessible.

Figure 5:
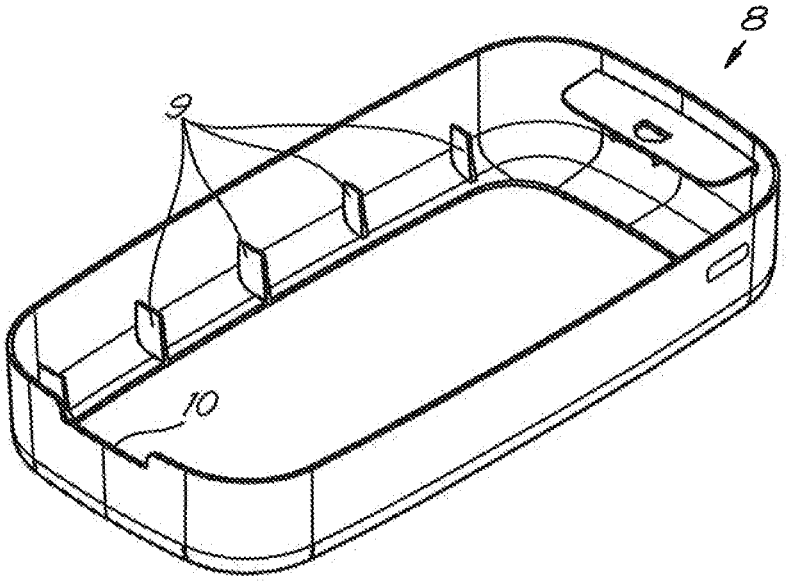
FIG. 5 shows a perspective view of a casing in which a box with lid according to the present disclosure can be placed.

FIG. 5 shows a perspective view of a casing 8 in which a box 2 with lid 3 according to the present disclosure can be placed, whereby the support ribs 9 are visible, which determine the correct position of the casing 8 around the box 2 and whereby also a recess 10 is provided in the wall of the casing 8 on the level of the hinge 4 connecting the box 2 with the lid 3.

The operation of the child-safe packaging for packaging consumer goods, smoking materials or medication according to the present disclosure is very simple and as follows.

The child-safe packaging 1 has a lid 2 which in closed condition does not protrude from the edge of the casing 8 which is positioned around the box 2 and is held in place by the support ribs 9 of the casing 8 in which the box 2 is placed.

In said position the lid 3 cannot be opened by an unsuspecting child because the gripping edge 3' of the lid is not accessible.

An adult can open the child-safe packaging by for instance pressing with the left thumb on the hinge side of the lid while pressing with thumb and index finger of the other hand on the casing on the level of the gripping edge 3' of the lid whereby the casing goes down a little, such that the gripping edge 3' becomes free and accessible and the lid can be pulled open using the gripping edge.

After taking the desired goods out of the packaging, the packaging can be closed again by closing the lid such that the lid no longer protrudes from the edge of the casing. The present disclosure also relates to a method for the manufacture of the child-safe packaging, which at least consists of the following steps:

(i) injection moulding a box and lid with gripping edge connected by a hinge in a first injection mould;

(ii) injection moulding a casing in which both the box and the lid with its gripping edge fit;

(iii) sliding the box in the casing and folding shut the lid around the hinge.

The present disclosure is by no means limited to the embodiments described as an example and shown in the figures, but a child-safe packaging according to the present disclosure can be realised in all kinds of forms and dimensions without departing from the scope of the present disclosure, as is described in the following claims.

The invention claimed is:

1. A packaging from synthetic material or biopolymers, consisting of a box with lid, whereby the lid is hingedly attached to the box on one side and on the other side is provided with a gripping edge, with which the lid can be lifted to open the lid, whereby the gripping edge is made inaccessible by a casing located around the box, the casing having to be manipulated to make the gripping edge accessible, after which the lid can be manually lifted, and whereby every box with lid is placed in a casing whereby the casing is fitted around the box and a top edge of the casing protrudes from a top edge of the lid or is flush with the top edge of the lid, such that the gripping edge of the lid is not accessible to a hand that wants to open the box, wherein the casing around the box is manipulated by compressing and/or pressing down the casing, such that the gripping edge of the lid is made accessible to open the lid by hand.

2. The packaging according to claim 1, wherein the box with lid and hinge is injection-moulded as one piece and the casing is injection-moulded as a separate component.

3. The packaging according to claim 1, wherein the lid is provided with an edge which forms an air and odour-tight seal with the box when the lid is closed.

4. The packaging according to claim 3, wherein the box with lid can be used to package smoking materials or medication.

5. The packaging according to claim 1, wherein the box with lid is made from a recyclable synthetic material or a biodegradable material.

6. A method for the manufacture of the packaging according to claim 1, the method comprising the following steps:

(i) injection moulding the box and the lid with gripping edge connected by the hinge in a first injection mould;

(ii) injection moulding the casing in which both the box and the lid with its gripping edge fit;

(iii) sliding the box in the casing and folding shut the lid around the hinge.

7. A packaging made from synthetic material or biopolymers, the packaging comprising:

a box;

a lid; and a casing, wherein one side of the lid is hingedly attached to the box and the other side of the lid is provided with a gripping edge configured to be lifted to open the lid, wherein the gripping edge is made inaccessible by the casing located around the box, the casing having to be manipulated to make the gripping edge accessible, after which the lid can be manually lifted, wherein the box with the lid is placed in the casing such that the casing is fitted around the box and a top edge of the casing protrudes from a top edge of the lid or is flush with the top edge of the lid, such that the gripping edge of the lid is not accessible to a hand to open the box, and wherein the casing around the box is manipulated by compressing and/or pressing down the casing, such that the gripping edge of the lid is made accessible to open the lid by hand.

* * * * *